US008360085B2

(12) United States Patent
Lee

(10) Patent No.: US 8,360,085 B2
(45) Date of Patent: Jan. 29, 2013

(54) TOP SUPPORT STRUCTURE OF TENT FRAME

(76) Inventor: Sunghee Lee, Fujian (CN)

( * ) Notice: Subject to any disclaimer, the term of this patent is extended or adjusted under 35 U.S.C. 154(b) by 22 days.

(21) Appl. No.: 12/921,687

(22) PCT Filed: Oct. 24, 2008

(86) PCT No.: PCT/CN2008/072821

§ 371 (c)(1),
(2), (4) Date: Dec. 8, 2010

(87) PCT Pub. No.: WO2009/117883

PCT Pub. Date: Oct. 1, 2009

(65) Prior Publication Data

US 2011/0108077 A1 May 12, 2011

(30) Foreign Application Priority Data

Mar. 28, 2008 (CN) ..... 2008 2 0101810 U
May 6, 2008 (CN) ..... 2008 2 0112050 U

(51) Int. Cl.
*E04H 15/48* (2006.01)

(52) U.S. Cl. ..... 135/135

(58) Field of Classification Search ..... 135/135, 135/147, 29; 403/170, 217, 218
See application file for complete search history.

(56) References Cited

U.S. PATENT DOCUMENTS

| | | | | | |
|---|---|---|---|---|---|
| 2,113,118 | A * | 4/1938 | Pyatt | 135/123 |
| 2,953,145 | A * | 9/1960 | Moss et al. | 135/98 |
| 3,054,413 | A * | 9/1962 | Eshelman | 135/123 |
| 4,966,178 | A * | 10/1990 | Eichhorn | 135/123 |
| 5,069,572 | A * | 12/1991 | Niksic | 403/170 |
| 5,423,341 | A * | 6/1995 | Brady | 135/139 |
| 5,666,986 | A * | 9/1997 | Fox | 135/135 |
| 5,797,695 | A * | 8/1998 | Prusmack | 403/170 |
| 7,341,071 | B2 * | 3/2008 | Lee | 135/128 |
| 7,841,572 | B2 * | 11/2010 | Chen et al. | 248/317 |
| 8,047,218 | B1 * | 11/2011 | Shin | 135/135 |
| 2004/0123889 | A1 * | 7/2004 | Liang | 135/29 |
| 2007/0051399 | A1 * | 3/2007 | Jung | 135/135 |
| 2010/0243015 | A1 * | 9/2010 | Danziger | 135/139 |

* cited by examiner

*Primary Examiner* — Noah Chandler Hawk

(57) ABSTRACT

A top support structure of a tent frame includes a top pivot holder (1), to which a plurality of support poles (10) are pivotally coupled. An elastic member (9) is provided between each support pole and the pivot holder. The elastic member folds and stores elasticity energy when the tent frame is folded and automatically springs the support poles when the elasticity energy is released. A control holder (2) is pivotally coupled to the bottom of the pivot holder, and the control holder has lock pieces (211) which can prop the support poles up to limit their rotation and release grooves (212) adjacent to the lock pieces which can release the limitation. On the top of pivot grooves (12) of the pivot holder are provided with position-limited devices (D) to prevent the support poles from rotating upwards.

17 Claims, 9 Drawing Sheets

TOP SUPPORT STRUCTURE OF TENT FRAME

BACKGROUND OF THE INVENTION

1. Field of the Invention

The present invention relates to a tent part, and more particularly to a top support structure of a tent frame.

2. Description of the Prior Art

A conventional automatic extendable tent frame comprises a top pivot holder. The pivot holder has pivot troughs for connection of support poles and elastic units which correspond in number to the support poles. When the support poles are folded downward with respect to the pivot holder, the elastic units provide elasticity. Each support pole is movably connected to the pivot holder and rotatable with relative to the pivot holder. One end of each elastic unit is connected to the support pole and another end of each elastic unit is connected to the pivot holder. It is required to apply a force to retract the support poles inward when folding the tent. When unfolding the tent, the restoring force of the elastic units will expand the support poles up relative to the pivot holder, providing an automatic extendable function. This shows that the top support frame of this tent depends on the elasticity of the elastic units. If the top of the tent is applied with a force, the support poles are easy to be folded downward. Thus, the support strength of the support poles is not enough. The outer support poles may be raised relative to the pivot holder subject to the elastic action of the elastic units. When the tent is influenced by wind force or external force, the tent frame is easy to shake. The tent lacks support stability.

SUMMARY OF THE INVENTION

The primary object of the present invention is to provide a top support structure to strengthen a tent frame, preventing support poles from folding downward when the top of the tent is applied with a force.

A further object of the present invention is to provide a top support structure to ensure the stability of the tent frame, with a better raised angle of the support poles.

In order to achieve the aforesaid objects, the solution of the present invention is to provide a top support structure of a tent frame.

The top support structure comprises a top pivot holder. The pivot holder is pivotally connected with support poles. An elastic member is provided between the pivot holder and each of the support poles. The elastic member is bent to store an elastic energy when the tent frame is folded. The elastic member will automatically spring a corresponding support pole when the elastic energy is released. Wherein a control holder is provided under the pivot holder and pivotally connected to the pivot holder. The control holder comprising lock pieces to hold against the support poles and to limit rotation of the support poles and release troughs each disposed between two of the adjacent lock pieces.

The pivot holder has pivot troughs to receive the support poles therein.

A position-limit device is provided on each of the pivot troughs to prevent the support poles from moving upward.

Each of the support poles is pivotally connected in a corresponding pivot trough through a connection head.

A metallic sleeve is provided between the connection head and a connection part of each of the support poles to enhance connection of the support pole and the connection head.

The connection head has a neck at a rear part thereof. The neck is inserted in a corresponding support pole. A metallic rod is provided in the neck to enhance the neck.

The control holder has an arc guide slot. A guide post is connected with the pivot holder and inserted through the guide slot. The central angle of the guide slot is equal to the central angle between two adjacent release troughs.

The control holder comprises a handle disposed under the control holder.

A metallic plate is provided in or on the control holder.

The position-limit device includes a positioning hole and a fixing hole disposed on two side walls of each of the pivot troughs of the pivot holder. A rotation shaft is inserted through a shaft hole of the support pole and fixed in the fixing hole. A positioning shaft is fixed in the positioning hole to block the support pole from moving upward.

The position-limit device includes a positioning hole and a fixing hole disposed on two side walls of each of the pivot troughs of the pivot holder. A rotation shaft is inserted through a shaft hole of the connection head and fixed in the fixing hole. A positioning shaft is fixed in the positioning hole to block the connection head from moving upward.

The positioning shaft is located above an outer side of the rotation shaft. One end of the elastic member is fixed to an inner side of the pivot holder, and the other end of the elastic member is fixed to the support pole.

The positioning shaft is located above an outer side of the rotation shaft. One end of the elastic member is fixed to an inner side of the pivot holder, and the other end of the elastic member strides over the positioning shaft and is fixed to the connection head.

The position-limit device includes a crescent groove of the connection head. The crescent groove is disposed between a top end of the connection head and a shaft hole. Two side walls of each of the pivot troughs of the pivot holder have a positioning hole and a fixing hole under the positioning hole. A rotation shaft is inserted through a shaft hole of the connection head and fixed in the fixing hole. A positioning shaft is fixed in the positioning hole and inserted through the crescent groove of the connection head to block the connection head from moving upward.

The position-limit device is a stop block which is integrally formed with each of the pivot troughs of the pivot holder. A corresponding support pole is located under the stop block and pivotally connected in a corresponding pivot trough.

The stop block has concave upper and lower surfaces. A first end of the elastic member is fixed to an inner side of the pivot trough, and a second end of the elastic member strides over the stop block and is connected to a corresponding support pole.

Each of the pivot troughs of the pivot holder is provided with a fixing axle to connect with one end of the elastic member.

Each of the support poles is provided with a connection block. The connection block has a connection axle to connect another end of the elastic member. The connection block is provided with a hook underneath the connection block.

A metallic sleeve is provided between the connection block and the connection head.

Each of the pivot troughs of the pivot holder is provided with a decoration cover to cover a corresponding support pole.

A front portion of the decoration cover is shaped like a hook and has a crescent groove and a shaft hole. The crescent groove and the shaft hole corresponding to a crescent groove and a shaft hole of a connection head. A rotation shaft is inserted through the shaft hole of the decoration cover and the shaft hole of the connection head to connect the decoration cover with the connection head.

The top support structure of a tent frame further comprises a top cover which is fixed on top of the pivot holder.

Accordingly, the rotatable control holder is provided under the pivot holder. The lock pieces and the release troughs of the control holder are turned to correspond to the pivot troughs of the pivot holder for the release troughs to be under the pivot troughs, such that the support poles can be turned relative to the pivot troughs (The control holder won't restrict turning of the support poles.) to fold the tent frame. The control holder is turned to achieve the aforesaid effect. This is convenient and quick way to fold the tent frame. When the tent is in an unfolded state, the lock pieces will be located under the pivot troughs. The support poles are supported on the lock pieces and can't be moved or folded downward. The tent frame is unfolded steadily.

Besides, the pivot holder is provided with the position-limit device to restrict the angle of the support poles to be moved upward, so the support poles are steady after the tent is unfolded. By the control holder to position the support poles, the unfolded tent frame has upper and lower positioning effects to secure the tent firmly.

Embodiments of the present invention will now be described, by way of example only, with reference to the accompanying drawings.

DETAILED DESCRIPTION OF THE PREFERRED EMBODIMENTS

Figure 1:
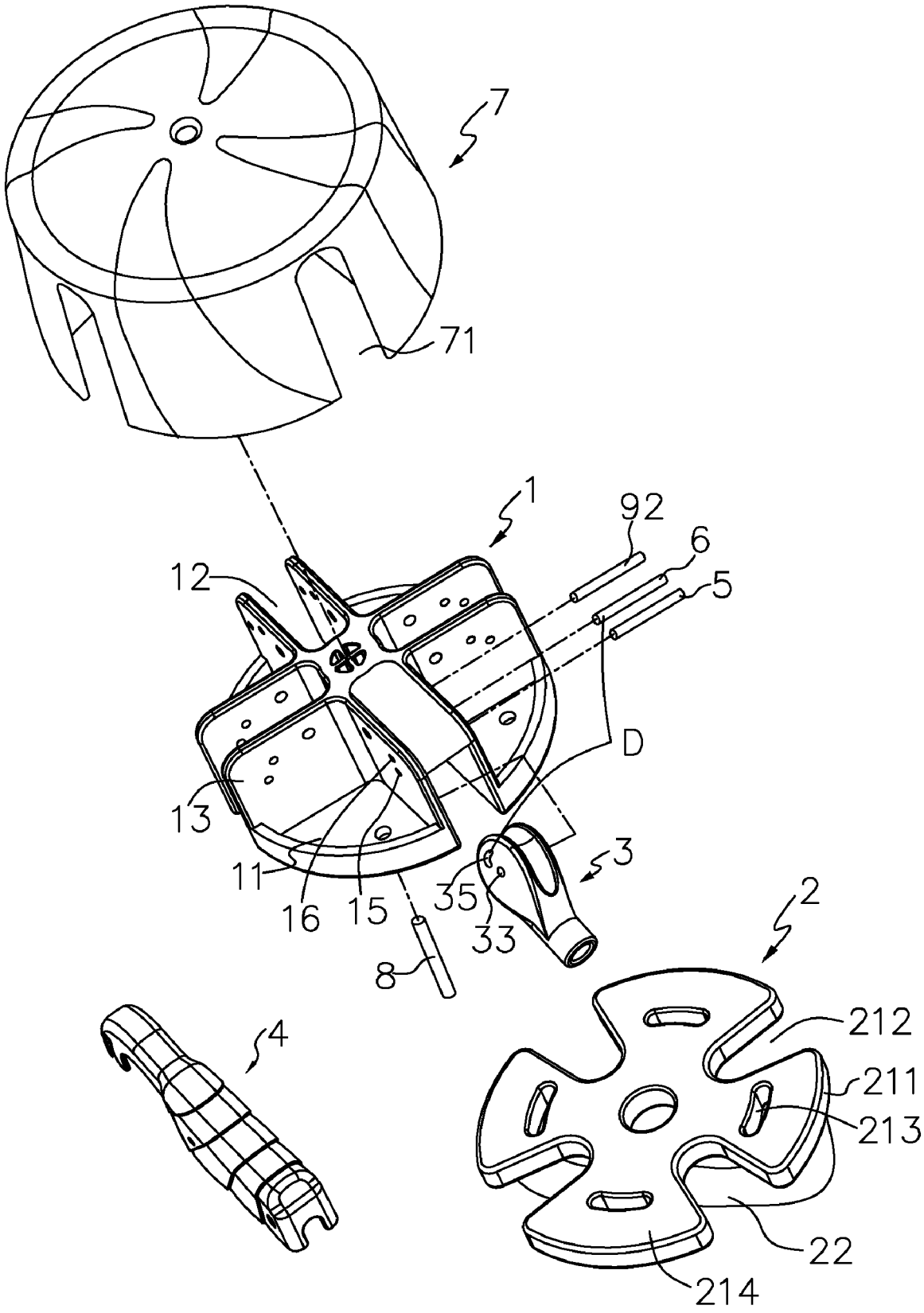
FIG. 1 is an exploded view according to a first embodiment of the present invention.
Figure 6:
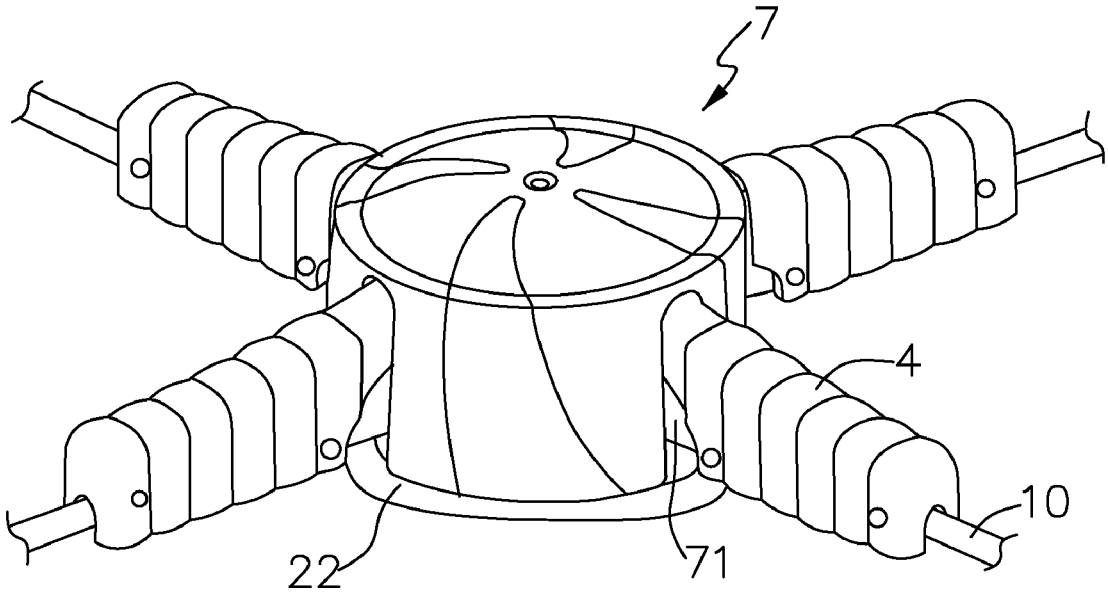
FIG. 6 is a perspective view according to the first embodiment of the present invention.
Figure 7:
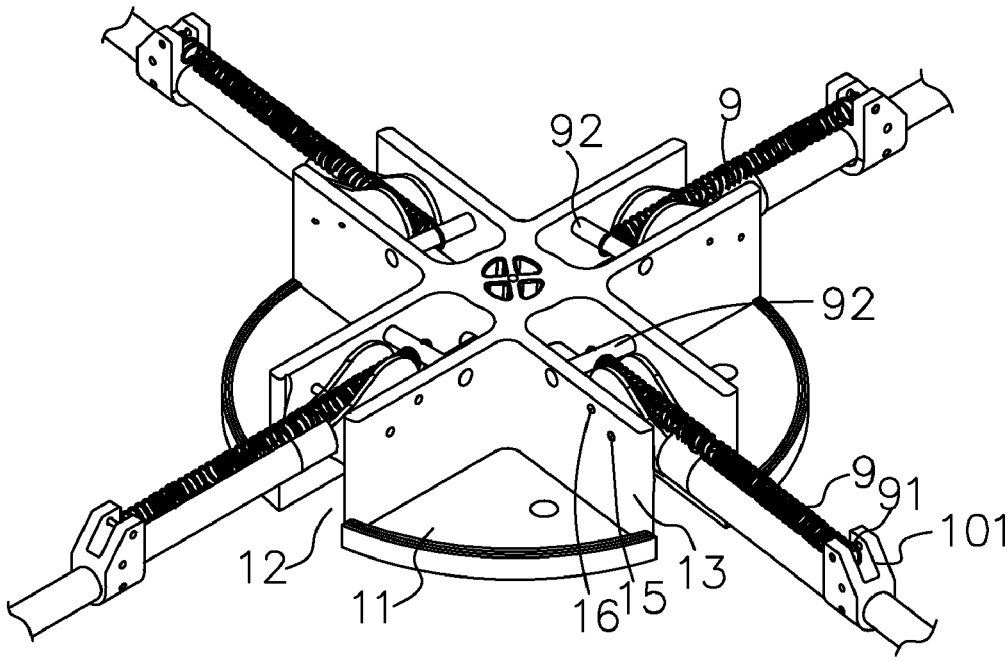
FIG. 7 is partially schematic view according to the first embodiment of the present invention.

As shown in FIG. 1, FIG. 6 and FIG. 7, a top support structure of a tent frame according to a first embodiment of the present invention is connected with support poles 10 and elastic members 9. The elastic members 9 will be bent to store elastic energy when the tent is folded. The elastic members 9 can automatically spring the support poles 10 when the elastic energy is released.

The top structure comprises a pivot holder 1, a control holder 2, four connection heads 3, a decoration cover 4, a rotation shaft 5, a position-limit device D, and a top cover 7. The position-limit device D includes a positioning shaft 6 and a crescent groove 35 of the connection head 3.

The top cover 7 is coupled to the pivot holder 1. The control holder 2 is pivotally connected to the pivot holder 1 and rotatable with respect to the pivot holder 1. Inner ends of the four connection heads 3 are inserted through the notches 71 of the top cover 7 and pivotally connected to the pivot holder 1, respectively. Outer ends of the four connection heads 3 are connected to the support poles 10, respectively.

Figure 2A:
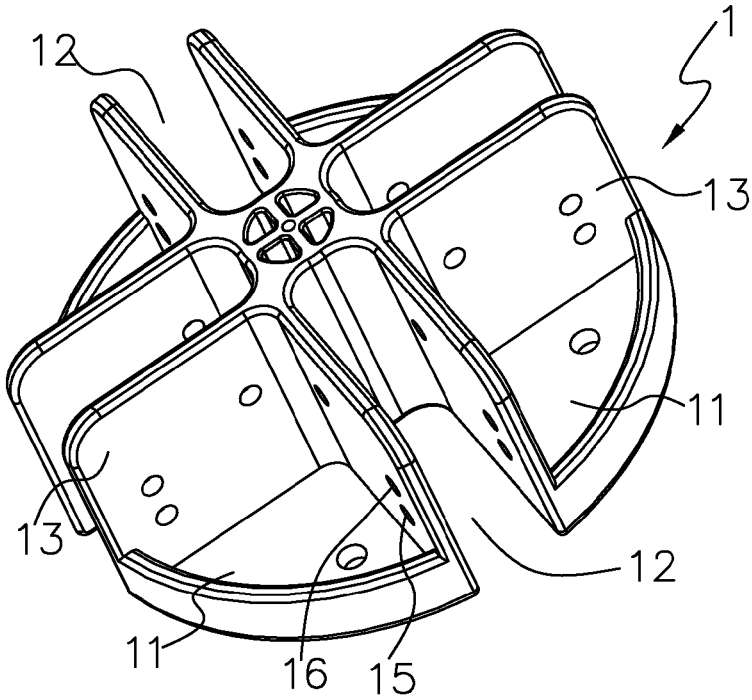
FIG. 2A, FIG. 2B and FIG. 2C are a top perspective view, a bottom perspective view and a cross-sectional view of the pivot holder according to the first embodiment of the present invention.
Figure 2B:
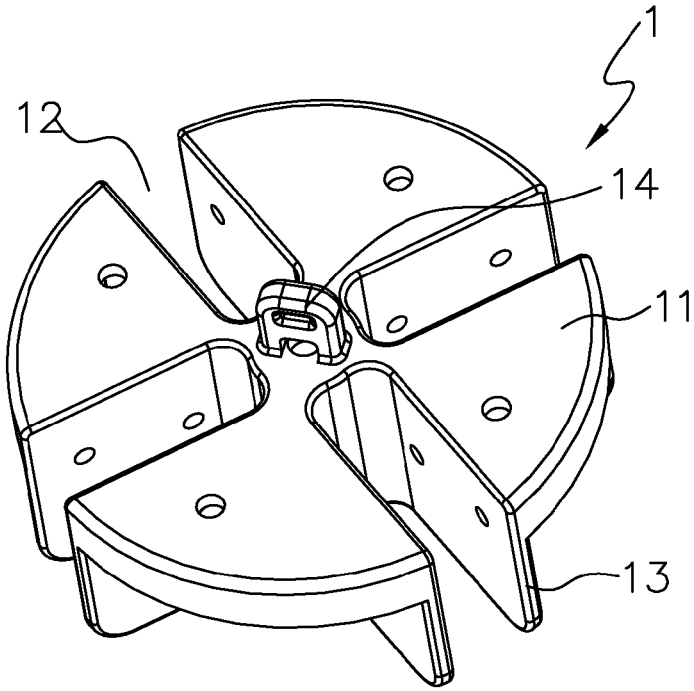
Figure 2C:
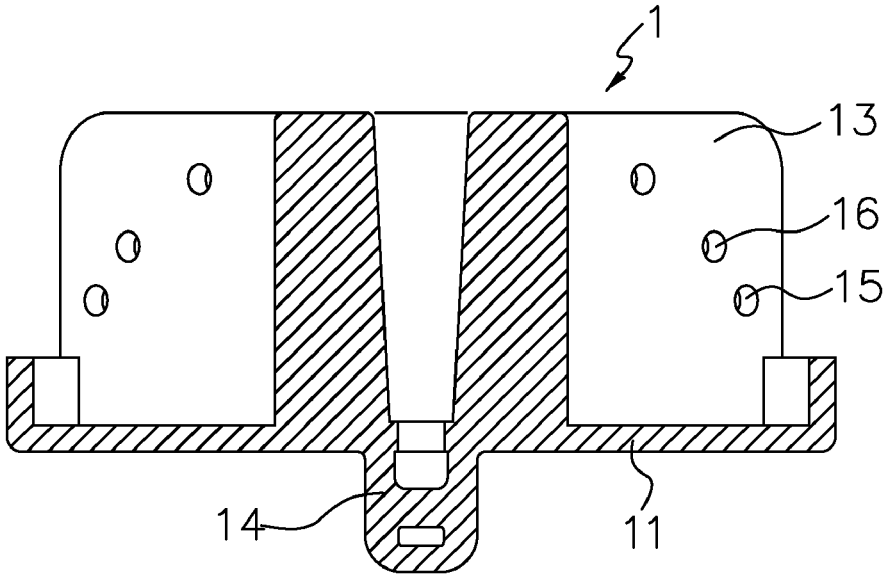

As shown in FIGS. 2A, 2B, and 2C, the pivot holder 1 comprises a base 11. The base 11 has four pivot troughs 12 which are equally spaced, a pair of ribs 13 at two sides of each of the pivot troughs 12, and spaced positioning protrusions 14 disposed under the base 11. The pivot trough 12 is defined between the pair of ribs 13. Each of the pair of ribs 13 is formed with a positioning hole 16 and a fixing hole 15 under the positioning hole 16. The rotation shaft 5 is inserted through a shaft hole 33 of the connection head 3 and fixed in the fixing hole 15. The positioning shaft 6 is fixed in the positioning hole 16.

Figure 3:
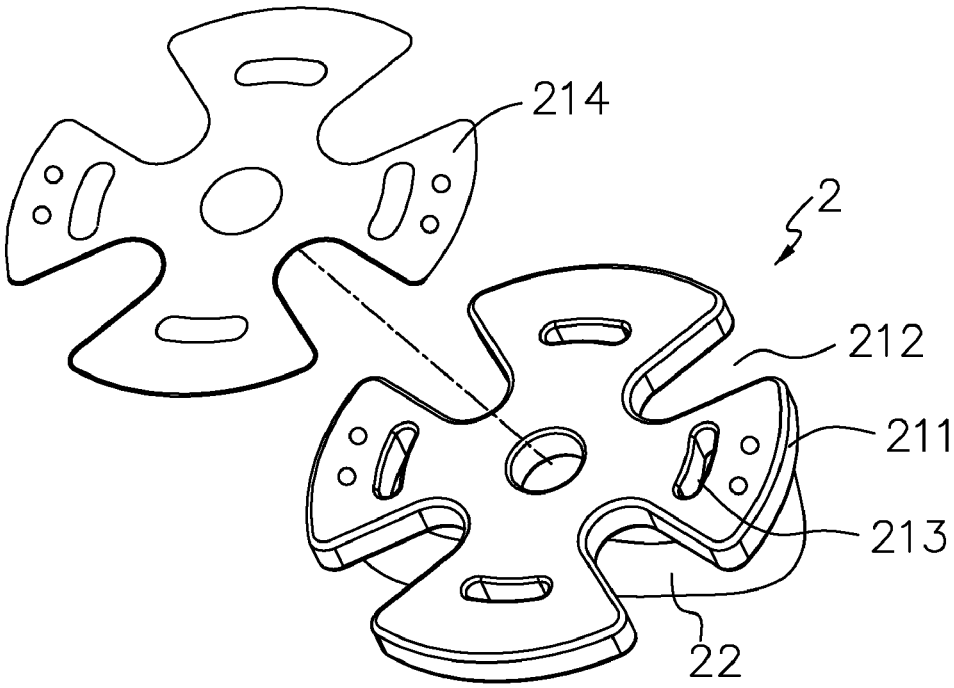
FIG. 3 is a perspective view of the control holder of the present invention.

As shown in FIG. 3, the control holder 2 comprises a control plate 21 and a handle 22 under the control plate 21. The control plate 21 has four lock pieces 211 to hold against the support poles 10 and to limit rotation of the support poles 10. A release trough 212 is formed between two adjacent lock pieces 211. Each of the lock pieces 211 has an arc guide slot 213. The axis of the guide slot 213 is overlapped with the axis of the control holder 2. The central angle of the guide slot 213 is equal to the central angle between two adjacent release troughs 212. In order to enhance the strength of the control holder 2, a metallic plate 214 may be provided in or on the control plate 21.

Referring to FIG. 1 and FIG. 3, the pivot holder 1 is provided with a guide post 8. A lower end of the guide post is moveably connected in the arc guide trough 213, so the control holder 2 under the pivot holder 1 is rotatable with respect to the holder 1. Outer edges of the lock pieces 211 of the control holder 2 are exposed out of an outer edge of the pivot holder 1. The spaced positioning protrusions are against a top surface of the control holder 2, such that a space is formed between the pivot holder 1 and the control holder 2. Due to the space, the support poles 10 are slightly oblique downward when they are in a locked state.

Figure 4A:
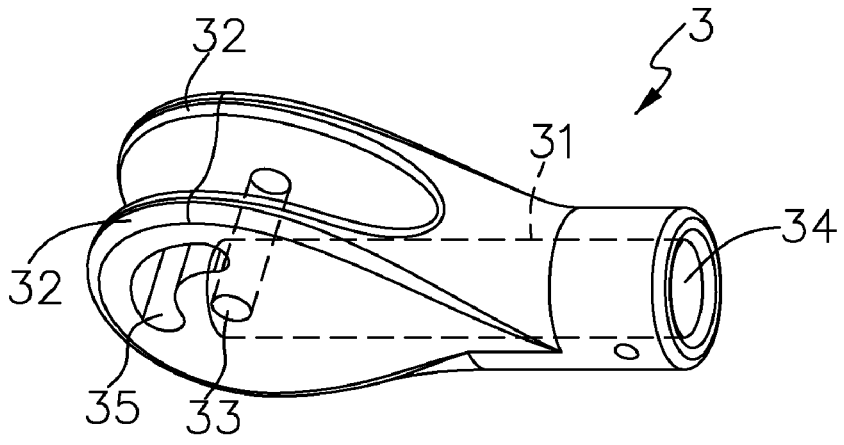
FIG. 4A, FIG. 4B and FIG. 4C are a perspective view, a front view and a top view of the connection head according to the first embodiment of the present invention.
Figure 4B:
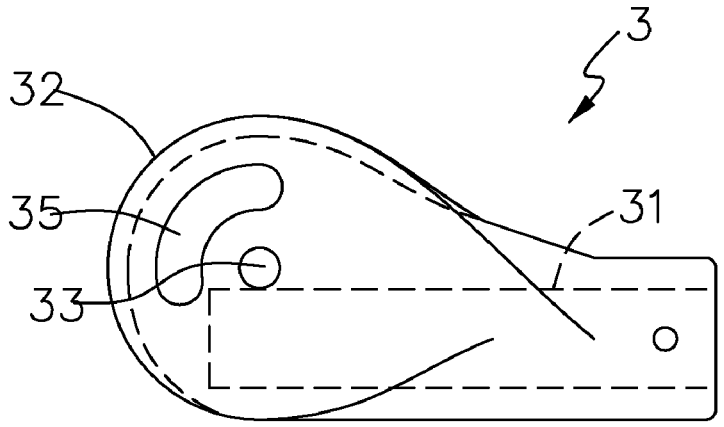
Figure 4C:
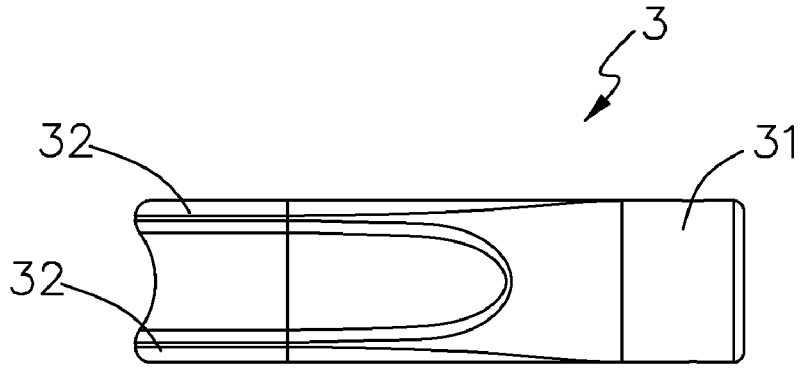

As shown in FIGS. 4A, 4B, and 4C, each of the connection heads 3 comprises a connection post 31 and a pair of connection lugs 32 at one end of the connection post 31. The pair of connection lugs 32 has the shaft hole 33 for insertion of the rotation shaft 5. The pair of connection lugs 32 is larger in area than the connection post 31. The connection post 31 has an inner axial hole 34 for insertion of a corresponding support pole 10 to be secured thereat. The pair of connection lugs 3 has the crescent groove 35 for insertion of the positioning shaft 6. The crescent groove 35 is disposed between a top end of the connection head 3 and the shaft hole 33. The positioning shaft 6 is inserted through the positioning hole 16 and secured in the crescent groove 35 of the connection head 3 to stop the connection head 3 from moving upward.

Figure 4D:
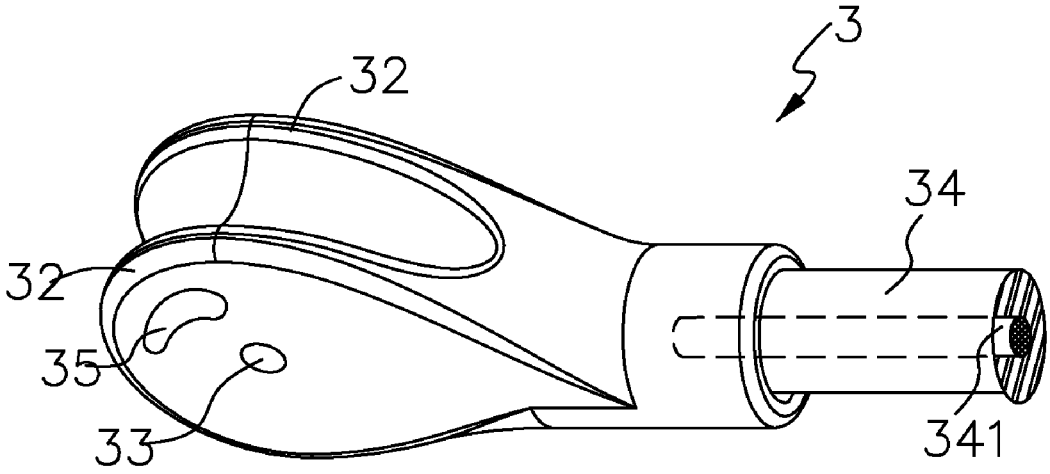
FIG. 4D is a perspective view of another embodiment of the connection head of the present invention.

As shown in FIG. 4D, the connection head 3 has a neck 34 instead of the axial hole 34. A metallic rod 341 is provided in the neck 34 to enhance the strength of the neck 34. The metallic rod 341 is connected to the support pole 10.

Figure 5A:
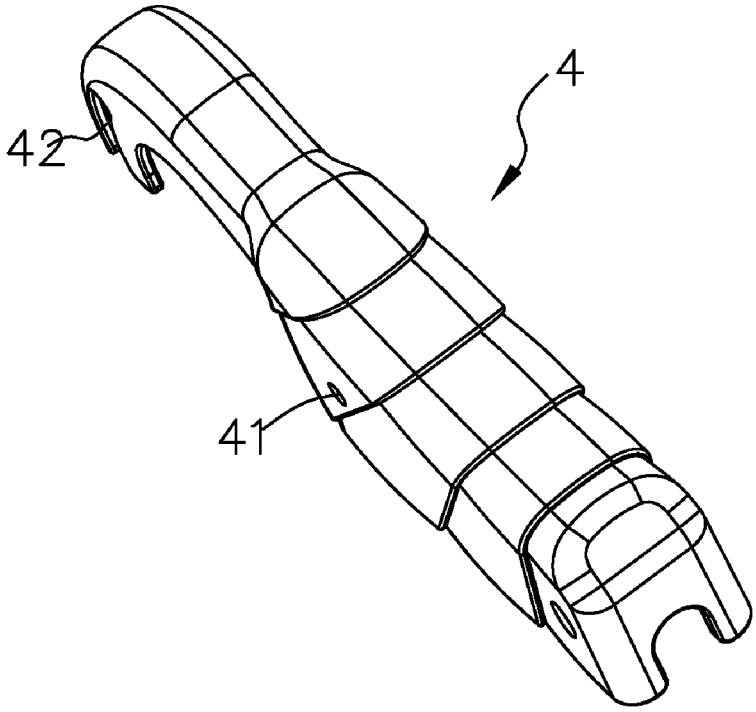
FIG. 5A, FIG. 5B and FIG. 5C are a perspective view, a front view and a top view of the decoration cover according to the first embodiment of the present invention.
Figure 5B:
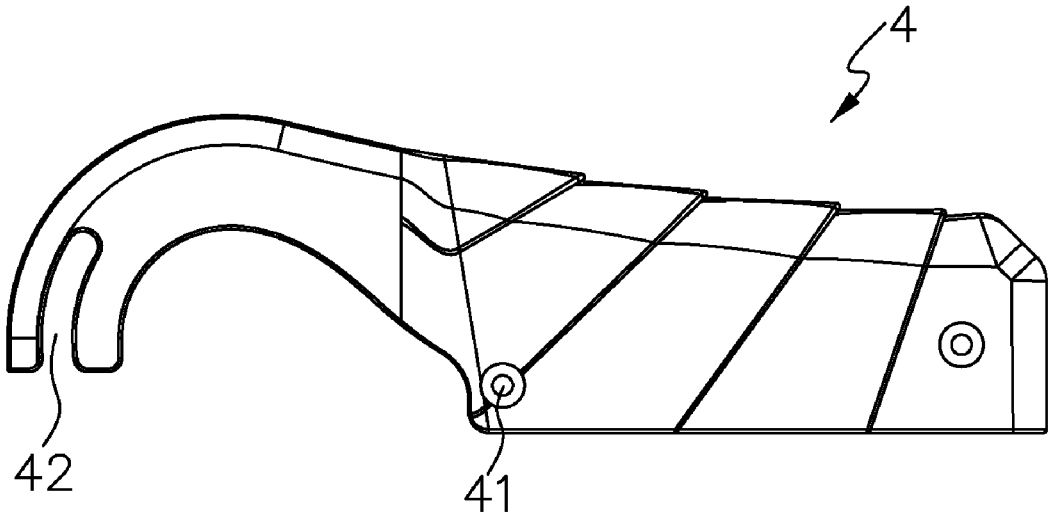
Figure 5C:
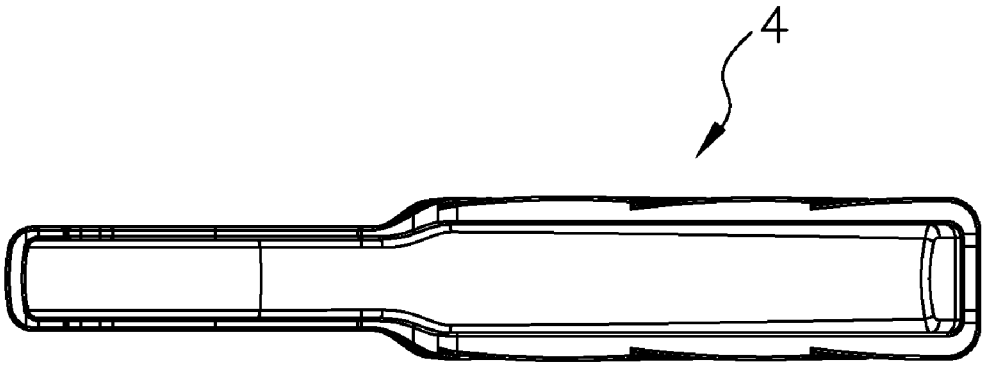

Referring to FIGS. 5A, 5B, 5C, a front portion of the decoration cover 4 is shaped like a hook and has a crescent groove 41 and a shaft hole 42. The crescent groove 41 and the shaft hole 42 correspond to the crescent groove 35 and the shaft hole 33 of the connection head 3. The rotation shaft 5 is inserted through the shaft hole 42 of the decoration cover 4 and the shaft hole 33 of the connection head 3 to connect the decoration cover 4 with the connection head 3.

As shown in FIG. 1, FIG. 6 and FIG. 7, to assemble the present invention, an upper end of each support poles 10 is inserted into the axial hole 34 of the connection post 31 of the connection head 3. In order to enhance the strength of the connection post 31, the connection post 31 may be provided with a metallic sleeve. The connection head 3 is located in the pivot trough 12 of the pivot holder 1. The rotation shaft 5 is inserted in the fixing holes 15 of the pair of ribs 13 of the pivot holder 1 and the shaft holes 33 of the pair of lugs 32 of the connection head 3, so the support pole 10 is pivotally connected in the pivot trough 12 of the pivot holder 1. Referring to the FIG. 7, a first end of the elastic member 9 is fixed to a fixing axle 92, and a second end of the elastic member 9 is inserted through the pair of connection lugs 32 and connected to the support pole 10. The support pole 10 is provided with a connection block 101. The connection block 101 has a connection axle 91 to connect the second end of the elastic member 9. The elastic member 9 will generate elasticity when bent. In order to prevent the connection block 101 from loosening after a period of time, a metallic sleeve 102 is provided between the connection block 101 and the connection head 3 to limit the connection block 101 and to enhance the strength of the joint of the support pole 10 and the connection head 3. When folding the tent frame, the elastic member 9 will be bent to store elastic energy. The elastic energy will automatically spring the support pole 10 when the elastic member 9 is released.

To fold the tent frame, the control holder 2 is turned for the arc guide slot 213 to correspond to the guide post 8. When the release trough 212 is aligned with the pivot trough 12, the user can move the support poles 10 downward with respect to the pivot holder 1 to bend the elastic members 9. To unfold the tent frame, the elastic energy is released to spring the support poles 10, and the control holder 2 is turned for the lock pieces 211 to be located under the pivot troughs 12, and the connection heads 3 are against the lock pieces 211, so the support poles 10 are unfolded steadily.

Figure 8:
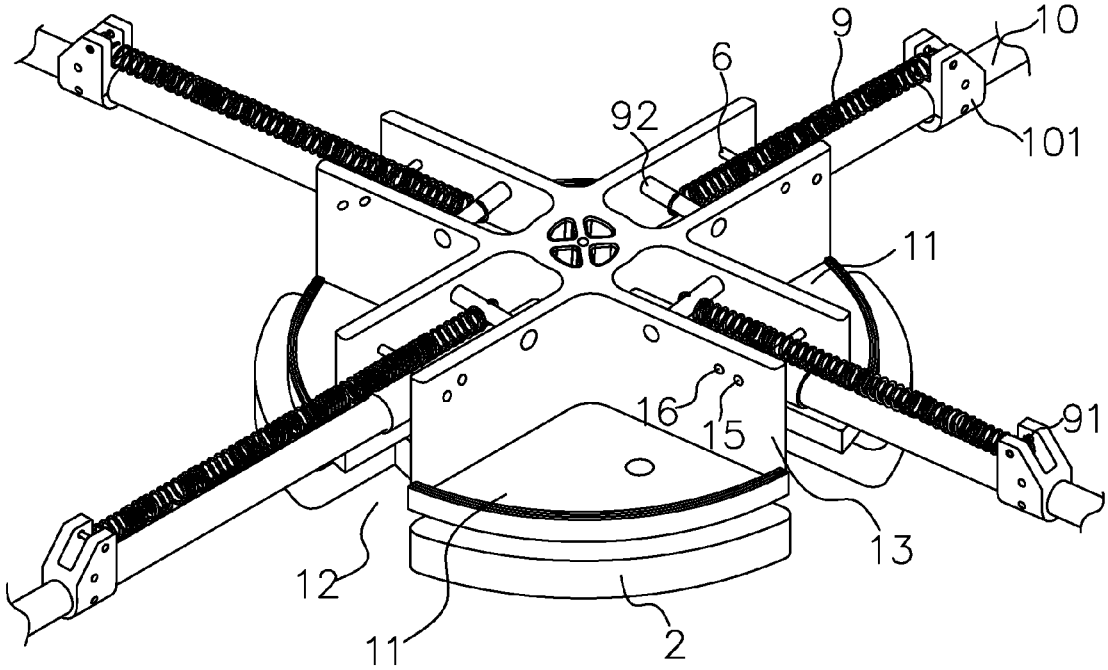
FIG. 8 is a perspective view according to a second embodiment of the present invention.

FIG. 8 shows a second embodiment of the present invention, which is substantially similar to the first embodiment with the exceptions described hereinafter. The position-limit device D is the positioning hole 16 and the fixing hole 15 formed on two side walls of the pivot trough 12 of the pivot holder 1. The two side walls are formed with, respectively. The support pole 10 is pivoted in the pivot trough 12 through the rotation shaft 5. The positioning shaft 6 is located above the rotation shaft 5. The first end of the elastic member 9 is fixed to the fixing axle 92 which is located at an inner side of the pivot trough 12. The second end of the elastic member 9 strides over the positioning shaft 6 and is connected to the connection axle 91 of the connection block 101 of the support pole 10. In this embodiment, the positioning shaft 6 also prevents the support pole 10 from moving upward. The support pole 10 is also connected to the pivot holder 1 through the connection head 3.

Figure 9:
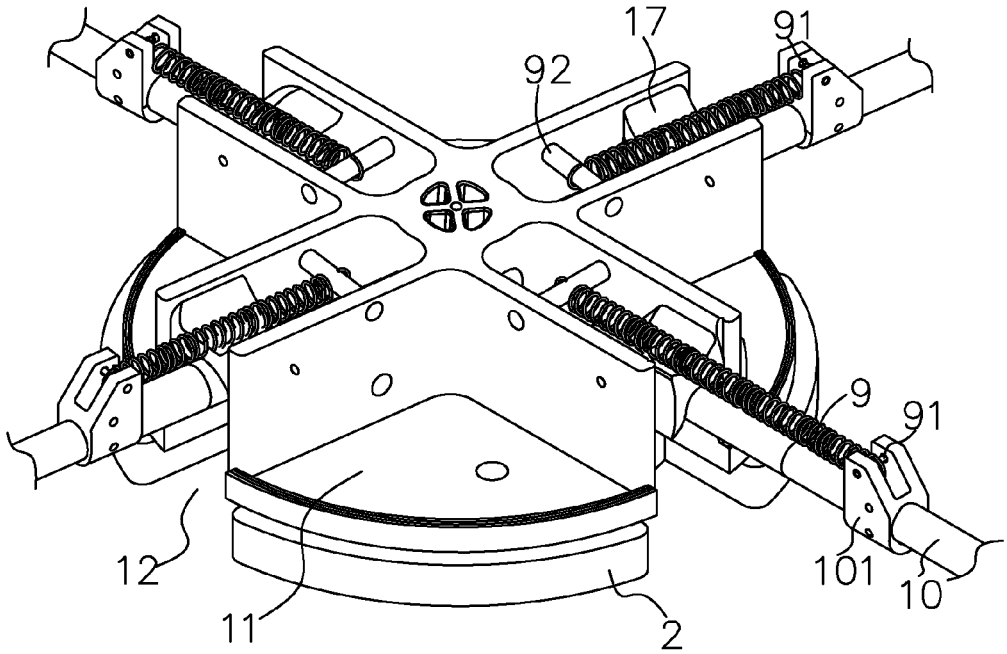
FIG. 9 is a perspective view according to a third embodiment of the present invention.
Figure 10:
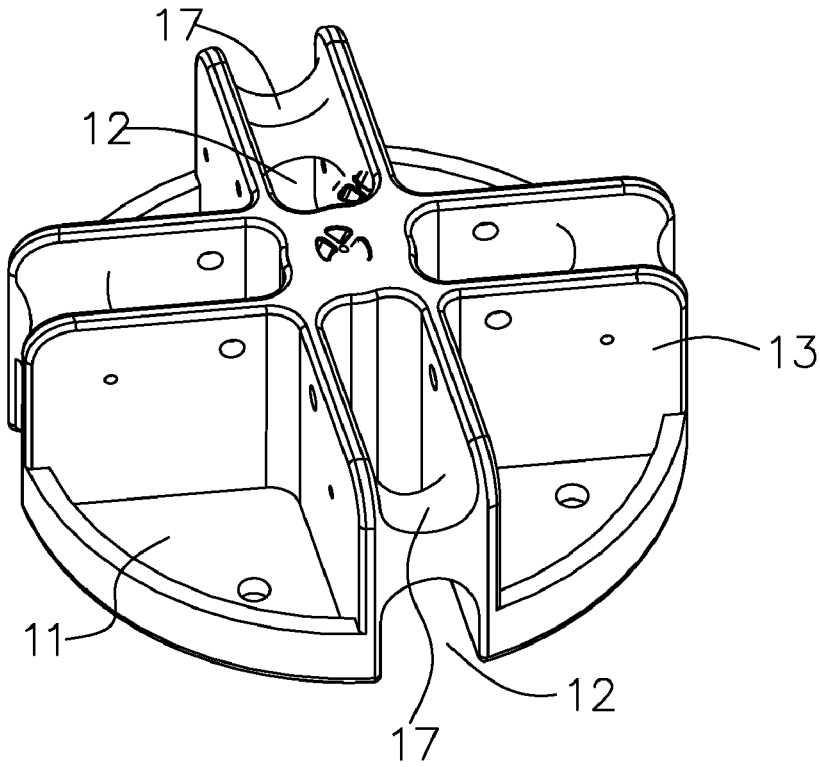
FIG. 10 is a perspective view of the pivot holder according to the third embodiment of the present invention.

FIG. 9 and FIG. 10 show a third embodiment of the present invention, which is substantially similar to the first embodiment with the exceptions described hereinafter. The position-limit device D is a stop block 17 which is integrally formed with the pivot trough 12 of the pivot holder 1. The stop block 17 has concave upper and lower surfaces. The support pole 10 is located under the stop block 17 and pivotally connected in the pivot trough 12. The first end of the elastic member 9 is fixed to the fixing axle 92 which is located at an inner side of the pivot trough 12. The second end of the elastic member 9 strides over the stop block 17 and is connected to the connection axle 91 of the connection block 101 of the support pole 10. The stop block 17 provides a limit effect to the unfolded support pole 10.

Figure 11:
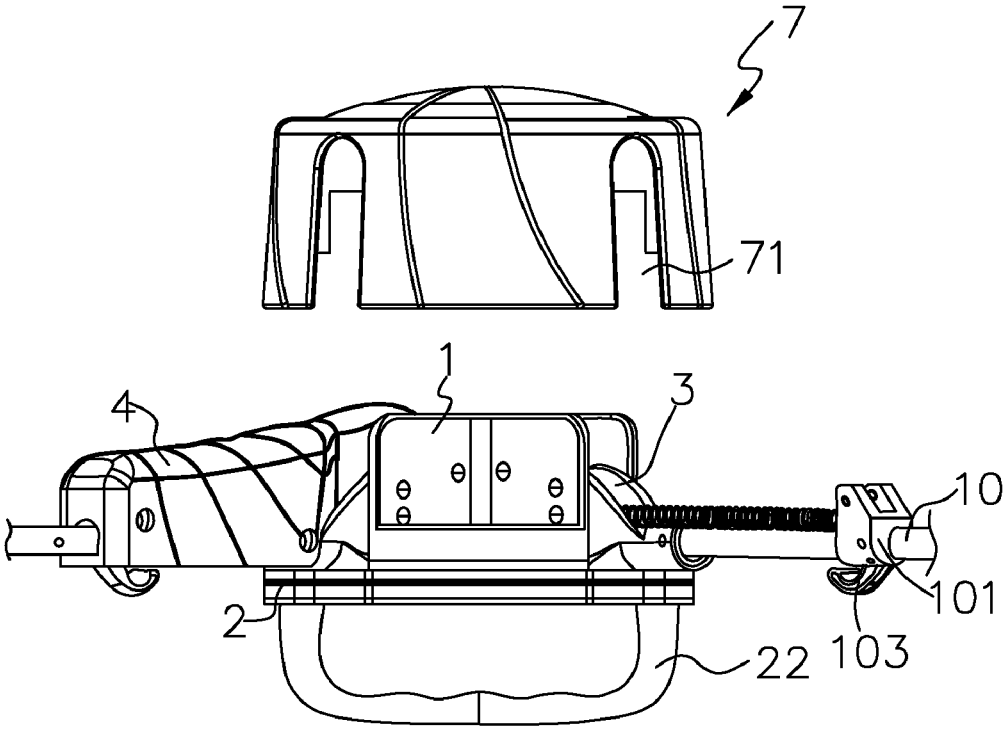
FIG. 11 is a front view according to a fourth embodiment of the present invention.

As shown in FIG. 11, the connection block 101 may be provided with a hook 103 underneath the connection block 101 to secure the tent cloth.

The feature of the present invention is that the rotatable control holder 2 is provided under the pivot holder 1. The lock pieces 211 and the release troughs 212 of the control holder 2 are turned to correspond to the pivot troughs 12 of the pivot holder 1 for the release troughs 212 to be under the pivot troughs 12, such that the support poles 10 can be turned relative to the pivot troughs 12 (The control holder 2 won't restrict turning of the support poles 10) to fold the tent frame. The control holder 2 is turned to achieve the aforesaid effect. This is convenient and quick way to fold the tent frame. When the tent is in an unfolded state, the lock pieces 211 will be located under the pivot troughs 12. The support poles 10 are supported on the lock pieces 211 and can't be moved or folded downward. The tent frame is unfolded steadily. Besides, the pivot holder 1 is provided with the position-limit device D to restrict the angle of the support pole 10 to be moved upward, so the support poles 10 are steady after the tent is unfolded. By the control holder to position the support poles 10, the unfolded tent frame has upper and lower positioning effects to secure the tent firmly.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A top support structure of a tent frame, comprising a pivot holder, the pivot holder being pivotally connected with support poles, an elastic member provided between the pivot holder and each of the support poles, the elastic member being bent to store an elastic energy when the tent frame is folded, the elastic member automatically springing a corresponding support pole when the elastic energy is released, a first end of the elastic member fixed to an inner side of a pivot trough of the pivot holder, a second end of the elastic member connected to the support pole;

a control holder provided under the pivot holder and pivotally connected to the pivot holder, the control holder comprising:

a control plate, and a handle disposed under the control plate, wherein the control plate comprising:

lock pieces to hold against the support poles for limiting rotation of the support poles, and a release trough formed between two adjacent lock pieces, with each of the lock pieces including an arc guide slot, an axis of a guide slot overlapped with an axis of the control holder a central angle of the guide slot is equal, in size, to a central angle between two adjacent release troughs;

the pivot holder is provided with a guide post; and a lower end of the guide post is moveably connected in the arc guide trough.

2. The top support structure of a tent frame as claimed in claim 1, wherein the pivot holder has the pivot troughs to receive the support poles therein.

3. The top support structure of a tent frame as claimed in claim 2, wherein each of the pivot troughs of the pivot holder is provided with a fixing axle to connect with one end of the elastic member.

4. The top support structure of a tent frame as claimed in claim 2, wherein a position-limit device is provided on each of the pivot troughs to prevent the support poles from moving upward.

5. The top support structure of a tent frame as claimed in claim 4, wherein the position-limit device is a stop block which is integrally formed with each of the pivot troughs of the pivot holder, a corresponding support pole being located under the stop block and pivotally connected in a corresponding pivot trough.

6. The top support structure of a tent frame as claimed in claim 4, wherein each of the support poles is pivotally connected in a corresponding pivot trough through a connection head.

7. The top support structure of a tent frame as claimed in claim 6, wherein a metallic sleeve is provided between the connection head and a connection part of each of the support poles to enhance connection of the support pole and the connection head.

8. The top support structure of a tent frame as claimed in claim 6, wherein the connection head has a neck at a rear part thereof, the neck being inserted in a corresponding support pole, a metallic rod being provided in the neck to enhance the neck.

9. The top support structure of a tent frame as claimed in claim 6, wherein a position-limit device includes a crescent groove of the connection head, the crescent groove being disposed between a top end of the connection head and a shaft hole, two side walls of each of the pivot troughs of the pivot holder having a positioning hole and a fixing hole under the positioning hole, a rotation shaft being inserted through a shaft hole of the connection head and fixed in the fixing hole, a positioning shaft being fixed in the positioning hole and inserted through the crescent groove of the connection head to block the connection head from moving upward.

10. The top support structure of a tent frame as claimed in claim 1, wherein a metallic plate is provided in or on the control holder.

11. The top support structure of a tent frame as claimed in claim 10, wherein a stop block has concave upper and lower surfaces, the first end of the elastic member being fixed to an inner side of the pivot trough, the second end of the elastic member striding over the stop block and being connected to the corresponding support pole.

12. The top support structure of a tent frame as claimed in claim 11, wherein a metallic sleeve is provided between a connection block and a connection head.

13. The top support structure of a tent frame as claimed in claim 12, wherein a front portion of a decoration cover is shaped like a hook and has a crescent groove and a shaft hole, the crescent groove and the shaft hole corresponding to a crescent groove and a shaft hole of a connection head, a rotation shaft is inserted through the shaft hole of the decoration cover and the shaft hole of the connection head to connect the decoration cover with the connection head.

14. The top support structure of a tent frame as claimed in claim 1, wherein each of the support poles is provided with a connection block, the connection block having a connection axle to connect another end of the elastic member.

15. The top support structure of a tent frame as claimed in claim 14, wherein the connection block is provided with a hook underneath the connection block.

16. The top support structure of a tent frame as claimed in claim 1, wherein each of the pivot troughs of the pivot holder is provided with a decoration cover to cover a corresponding support pole.

17. The top support structure of a tent frame as claimed in claim 1, further comprising a top cover which is fixed on top of the pivot holder.

* * * * *